US006523304B2

(12) United States Patent
Weder

(10) Patent No.: US 6,523,304 B2
(45) Date of Patent: Feb. 25, 2003

(54) FLOWER POT COVER

(75) Inventor: Donald E. Weder, Highland, IL (US)

(73) Assignee: Southpac Trust Int'l Inc.

( * ) Notice: Subject to any disclaimer, the term of this patent is extended or adjusted under 35 U.S.C. 154(b) by 11 days.

(21) Appl. No.: 09/861,829

(22) Filed: May 21, 2001

(65) Prior Publication Data

US 2002/0189165 A1 Dec. 19, 2002

Related U.S. Application Data

(60) Provisional application No. 60/206,563, filed on May 22, 2000.

(51) Int. Cl.[7] ..... A47G 7/08
(52) U.S. Cl. ..... 47/72
(58) Field of Search ..... D9/433; 47/72, 47/41.01; 206/423

(56) References Cited

U.S. PATENT DOCUMENTS

| | | | | | |
|---|---|---|---|---|---|
| 1,446,014 | A | | 2/1923 | Lodge | |
| 2,355,559 | A | | 8/1944 | Renner | |
| 3,940,142 | A | * | 2/1976 | Hinz et al. | 273/145 C |
| 4,418,497 | A | * | 12/1983 | Mastriano | 206/423 |
| 4,788,109 | A | * | 11/1988 | Mage | 428/542.8 |
| 4,953,779 | A | * | 9/1990 | Densen | 206/459.5 |
| 5,073,161 | A | | 12/1991 | Weder et al. | |
| 5,106,449 | A | | 4/1992 | Fazzina et al. | |
| 5,142,512 | A | * | 8/1992 | Takano et al. | 368/232 |
| 5,147,706 | A | | 9/1992 | Kingman | |
| 5,339,565 | A | | 8/1994 | Weder et al. | |
| 5,402,601 | A | | 4/1995 | Garcia | |
| 5,443,670 | A | * | 8/1995 | Landau | 156/184 |
| 5,501,039 | A | | 3/1996 | Weder et al. | |
| 5,560,488 | A | * | 10/1996 | Weder | 206/438 |
| 5,573,789 | A | | 11/1996 | Weder et al. | |
| 5,716,474 | A | | 2/1998 | Weder et al. | |
| 5,727,362 | A | * | 3/1998 | Weder | 53/397 |
| 5,807,224 | A | | 9/1998 | Weder | |
| 6,090,027 | A | * | 7/2000 | Brinkman | 156/DIG. 4 |

FOREIGN PATENT DOCUMENTS

| | | |
|---|---|---|
| JP | 10-305168 | * 11/1998 |
| JP | 2000-326662 | * 11/2000 |

OTHER PUBLICATIONS

Bay City Flower Co.; There's No Comparision Heather From Hana Bay; Super Floral Magazine; Feb. 1998; 1 page.

* cited by examiner

*Primary Examiner*—Charles T. Jordan
*Assistant Examiner*—Jeffrey L. Gellner
(74) *Attorney, Agent, or Firm*—Dunlap Codding & Rogers

(57) ABSTRACT

A pot cover constructed such that a decoration can be included on the pot cover and the integrity of the decoration is maintained because the configuration of the pot cover does not result in the formation of arbitrary overlapping folds. The configuration of the pot cover allows a flower pot to be covered while the integrity of the decoration, such as a design or pattern, printed on each segment is maintained so that a decoration is presented throughout the outer peripheral surface of the formed pot cover.

18 Claims, 5 Drawing Sheets

FLOWER POT COVER

CROSS-REFERENCE TO RELATED APPLICATIONS

This application claims the benefit of U.S. Provisional Application Serial No. 60/206,563, filed May 22, 2000, and expressly incorporated herein by reference.

BACKGROUND OF THE INVENTION

1. Field of the Invention

The present invention relates generally to covers for providing decorative coverings for flower pots, and more particularly, but not by way of limitation, to a pot cover formed from a sheet of material folded so as to cause decoration on one portion of the sheet of material to be registered with decoration on another portion of the sheet of material whereby the decoration provided on the sheet of material is minimally distorted upon forming the sheet of material into the flower pot cover.

2. Brief Description of the Related Art

Pre-formed flower pot covers formed of a flexible sheet of material have been used for many years to enhance the aesthetic appearance of a potted plant. Such covers are generally formed between a pair of dies. In this process, a plurality of randomly oriented or arbitrary overlapping folds are formed in the sheet of material.

While the overlapping folds cooperate to provide structural strength to keep the preformed shape of the flower pot cover, they make it impossible to display a design on the cover wherein the design is not mutilated or distorted because arbitrary portions of the designs are covered by the overlapping folds.

To this end, a need has long existed for a flower pot cover which has a design printed thereon wherein the integrity of the design is maintained throughout the outer peripheral surface of the flower pot cover. It is to such a cover that the present invention is directed.

BRIEF SUMMARY OF THE INVENTION

The present invention is directed to a pot cover which is made in such a manner that a decoration can be included on the pot cover and the integrity of the design can be maintained in the pot cover because the configuration of the pot cover does not result in the formation of arbitrary overlapping folds. The configuration of the pot cover of the present invention allows a flower pot to be covered while the integrity of the decoration, such as a design or pattern, printed on each segment is maintained so that a decoration is presented throughout the outer peripheral surface of the formed pot cover.

Other features and advantages of the present invention will become apparent from the following detailed description when read in conjunction with the accompanying drawings and appended claims.

DETAILED DESCRIPTION OF THE INVENTION

Figure 1:
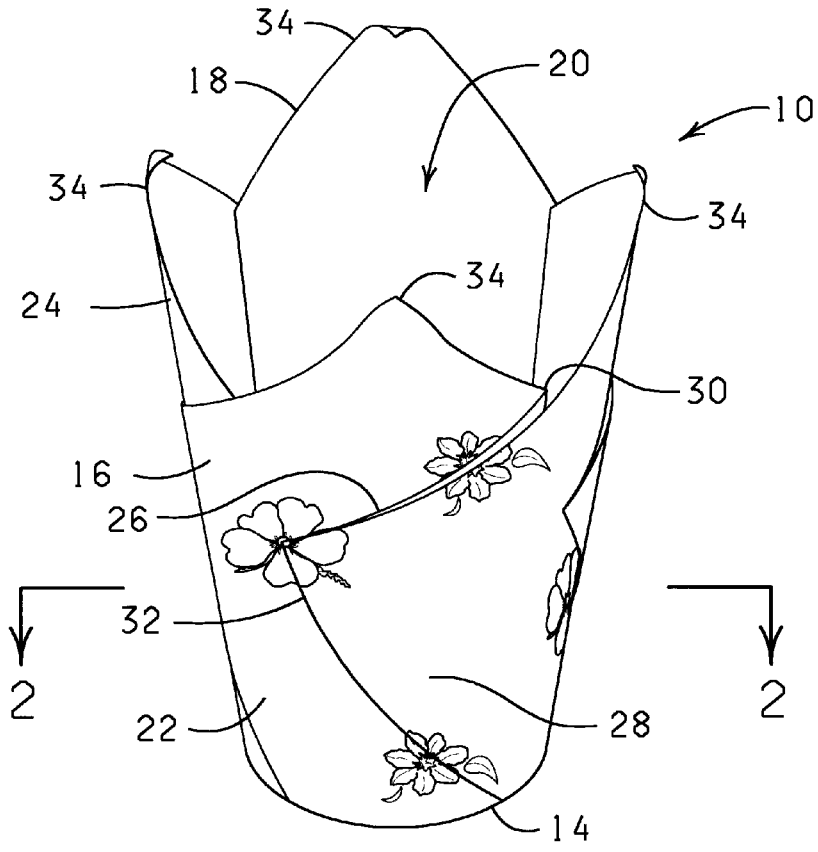
FIG. 1 is a perspective view of a pot cover constructed in accordance with the present invention.
Figure 2:
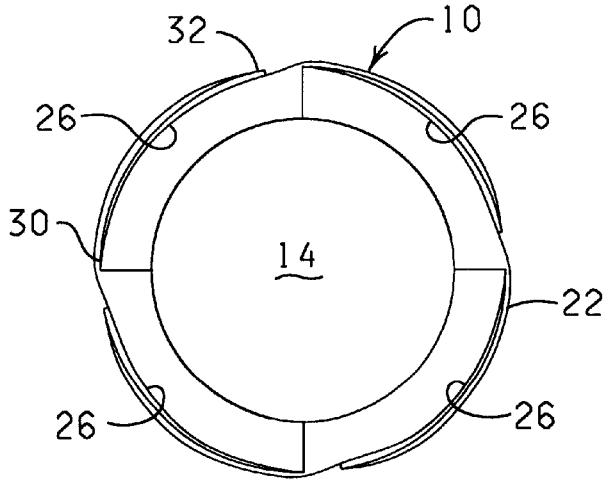
FIG. 2 is a sectional view taken along line 2—2 of FIG. 1.

Referring now to the drawings, and more particularly to FIGS. 1 and 2, a flower pot cover 10 constructed in accordance with the present invention is shown therein. The pot cover 10 is formed of a generally square-shaped, flexible sheet of material 12 shown in FIG. 3. The pot cover 10 includes a substantially closed, planar bottom 14, a sidewall 16, an open upper end 18, and an object opening 20. The sidewall 16 further has a base portion 22 and a skirt portion 24.

The base portion 22 is formed to include a preselected number of overlapping folds 26 and a corresponding number of panel sections 28 which are substantially free of folds, creases, and score lines. By forming the panel sections 28 to be substantially free of folds, creases or score lines, the outer surface of each of the panel sections 28 is smooth and thus printed matter or decorative designs maybe provided on the sheet of material 12 so as to be displayed on the panel sections 28 whereby the printed matter and decorative designs are displayed without being substantially distorted or mutilated by numerous folds or creases.

More specifically, the overlapping folds 26 of the base portion 22 include a first fold 30 and a corresponding second fold 32. The first and second folds 30 and 32 cooperate to form a substantially Z-shaped configuration, as best shown in FIG. 2. The first fold 30 is substantially vertically oriented along the length of the sidewall 16 while the second fold 32 is angled relative to the length of the sidewall 16 at an angle ranging from about 5 degrees to about 60 degrees. The overlapping folds 26 provide mechanical strength to the base portion 22 for enabling the base portion 22 to stand upright on the closed bottom 14 of the base portion 22. In this manner, the base portion 22 of the flower pot cover 10 has sufficient mechanical strength to stand upright about a flower pot without the necessity of mechanically connecting the base portion 22 to a flower pot, other than the connection normally provided when the lower end of a flower pot engages the bottom 14 of the flower pot cover 10 when the flower pot cover 10 is disposed about a flower pot. Thus, the overlapping folds 26 permit relatively thin sheets (films) of material to be utilized to form the flower pot cover 10.

The skirt portion 24 includes four petal-like portions 34. Each flared petal-like portion 34 terminates with a pointed end which is formed by one of the four corners of the square-shaped sheet of material 12. Further, each flared petal-like portion 34 extends a distance upwardly from the base portion 22 terminating with the pointed end of the flared petal-like portion 34. The flared petal-like portions 34 are spaced apart circumferentially about the skirt portion 24 with the flared petal-like portions 34 being spaced apart at about ninety degree intervals.

Figure 8:
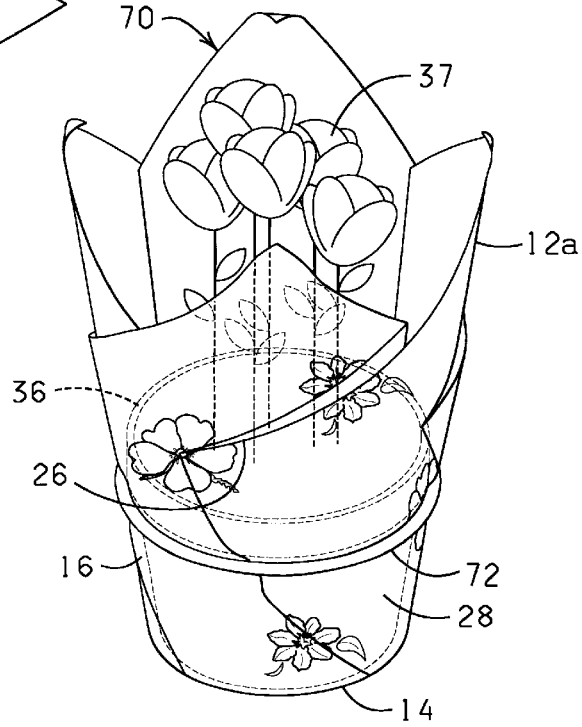
FIG. 8 is a perspective view of another embodiment of a pot cover constructed in accordance with the present invention.

The object opening 20 of the flower pot cover 10 is shaped and sized to receive a flower pot 36 (FIG. 8). When the flower pot 36 is disposed in the object opening 20 of the flower pot cover 10, the base portion 22 substantially encompasses the outer peripheral surface of the flower pot 36 extending generally between the upper and the lower ends of the flower pot 36 with the upper end of the base portion 22 being disposed generally near the upper end of the flower pot 36 and the closed bottom 14 of the flower pot cover 10 extends across and encompasses the lower end of the flower pot 36. When the flower pot cover 10 is disposed about the flower pot 36, the skirt portion 24 of the flower pot cover 10 extends a distance upwardly from the upper end of the flower pot 36 and the pot cover 10 extends generally circumferentially about the upper end of the flower pot 36.

Figure 3:
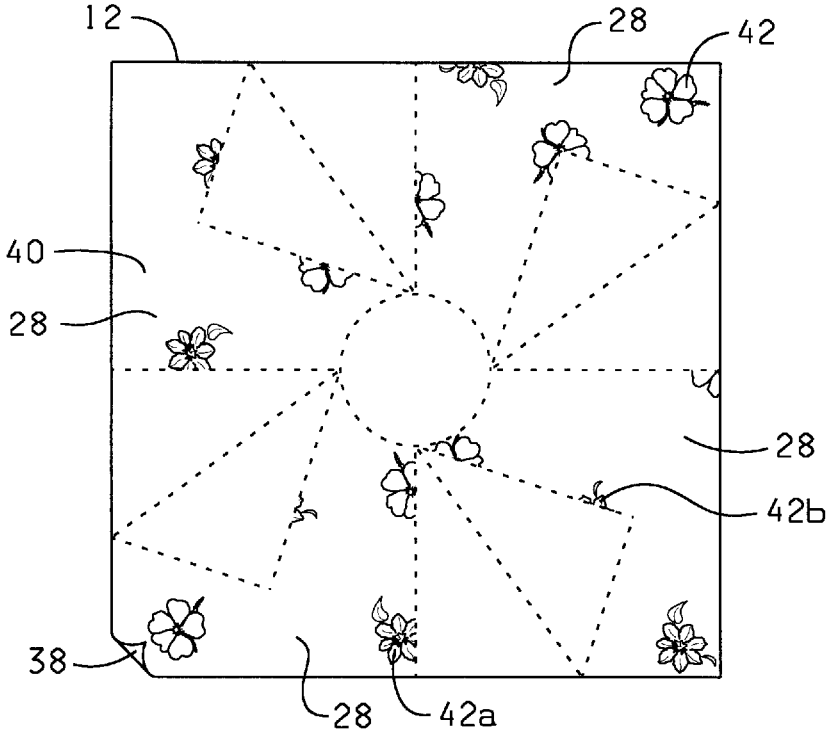
FIG. 3 is a bottom plan view of the sheet of material used to form the pot cover of FIG. 1.

Referring now to FIG. 3, the sheet of material 12 is characterized as having an upper surface 38 and a lower surface 40. The lower surface 38 is illustrated as being provided with a decoration 42. More particularly, the decoration 42 is selectively provided on only the portions of the sheet of material 12 which form the panel sections 28 of the pot cover 10 when formed. In addition, the decoration 42 is provided on the sheet of material 12 such that one portion of the decoration, such as portion 42*a*, will register with another portion of the decoration, such as portion 42*b*, upon formation of the pot cover 10 whereby the decoration 42 extends continuously from one panel section 28 to an adjacent panel section 28 without substantially mutilating the decoration 42, as shown in FIG. 1.

Figure 4:
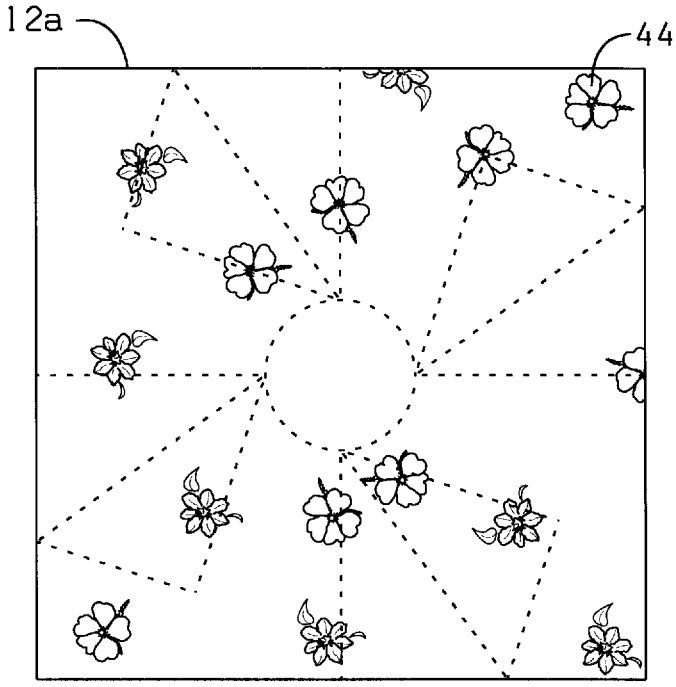
FIG. 4 is a bottom plan view of another version of a sheet of material for forming a pot cover in accordance with the present invention.

FIG. 4 illustrates another sheet of material 12*a* which can be utilized to form the flower pot cover 10. The sheet of material 12*a* is similar to the sheet of material 12 with the exception that a decoration 44 is provided throughout the sheet of material 12*a*, not only on the portions of the sheet of material 12*a* which form the panel sections 28 of the pot cover 10. However, like the decoration 42 of the sheet of material 12, the decoration 44 is provided on the sheet of material 12*a* such that the decoration portions are in register upon formation of the flower pot cover 10 whereby the decoration 44 extends from one panel section 28 to the adjacent panel section 28 without being substantially mutilated.

Figure 5:
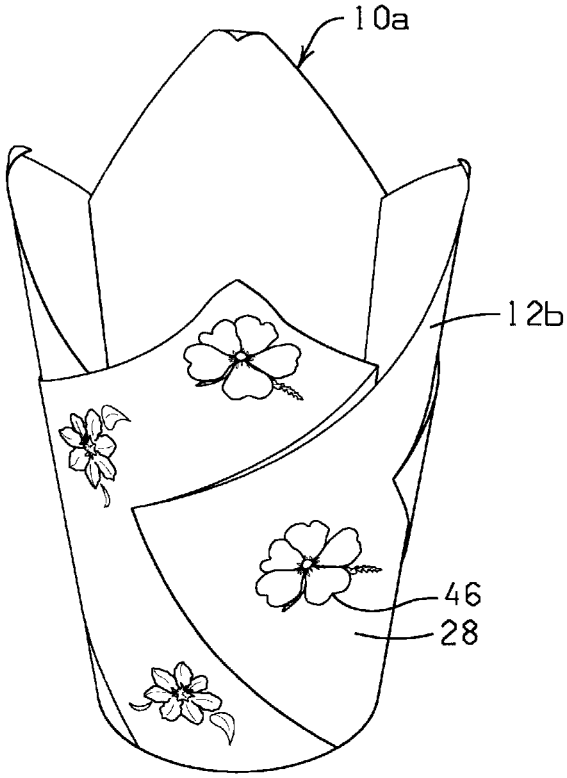
FIG. 5 is a perspective view of another embodiment of a pot cover constructed in accordance with the present invention.
Figure 6:
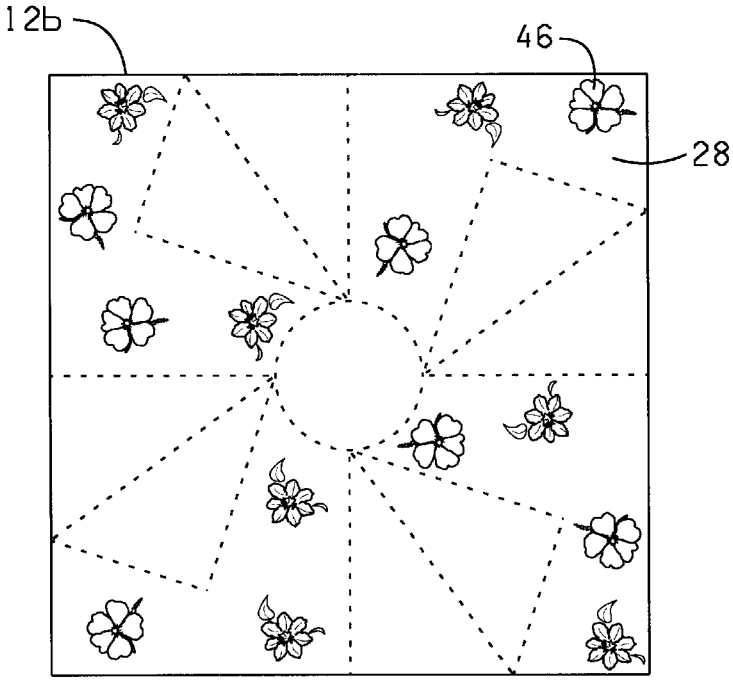
FIG. 6 is a bottom plan view of a sheet of material used to form the pot cover of FIG. 5.

FIG. 5 illustrates another embodiment of a pot cover 10*a* formed from a sheet of material 12*b*. The pot cover 10*a* is substantially identical to the pot cover 10 described above with the exception of the use of the sheet of material 12*b*. As best shown in FIG. 6, the sheet of material 12*b* is similar to the sheet of material 12*a* with the exception that a decoration 46 is provided only on the portions of the sheet of material 12*b* which form the panel sections 28 of the pot cover 10*a*. However, unlike the decoration 44 of the sheet of material 12*a*, all parts of the decoration 46 are formed in register with the portion of the sheet of material 12*b* which forms the panel sections 28 of the flower pot cover 10*a*. As such, various portions of the decoration 46 are not required to be registered with one another in the forming process. However, because the decoration 46 is formed on the panel sections 28, the decoration 46 extends from one panel section 28 to the adjacent panel section 28 without being substantially distorted, as shown in FIG. 5.

To form the pot covers 10 and 10*a*, either the upper surface 38 or the lower surface 40 or both the upper surface 38 and the lower surface 40 of the sheet of material 12, 12*a*, or 12*b* is adapted to be bondable so that when portions of the bondable surface are brought into bondable contact, such portions are bondably connected. The overlapping folds 26 are formed by overlapping portions of the bondable surface and bringing such overlapping portions into bondable engagement or contact. In this manner, the overlapping folds 26 are fixed in the pot covers 10 and 10*a*. When an overlapping fold 26 is formed with a portion of the sheet of material 12 during the forming of the pot covers 10 and 10*a*, portions of the upper surface 38 are overlapped and brought into bondable contact or engagement and, with respect to the same overlapping fold 26, portions of the lower surface 40 also are overlapped and brought into bondable contact or engagement.

As mentioned before, at least one of the upper and the lower surfaces 38 and 40 is prepared to form a bondable surface which is adapted to be bonded to portions of a similar bondable surface when bondably contacted with a similar bondable surface portion. Thus, in those instances when only the lower surface 40 is prepared to form a bondable lower surface 40, the overlapping portions of the bondable lower surface 40 are brought into bondable contact during the forming of the pot covers 10 and 10*a* and such overlapping portions are bonded to form the overlapping folds 26. The corresponding overlapping portions of the upper surface 38 are not bonded. Similarly, in those instances when only the upper surface 38 is prepared to form a bondable upper surface 38, the overlapping portions of the bondable upper surface 38 are brought into bondable contact during the forming of the pot covers 10 and 10*a* and such overlapping portions are bonded to form the overlapping folds 26. The corresponding overlapping portions of the lower surface 40 are not bonded. Finally, in those instances when both the upper and the lower surfaces 38 and 40 are prepared to form bondable upper and lower surfaces 38 and 40, the overlapping portions of the upper and the lower surfaces 38 and 40 forming each overlapping fold 26 are brought into bondable contact during the forming of the flower pot cover 10 and such overlapping portions of the upper and the lower surfaces 38 and 40 are bonded to form the overlapping folds 26.

It has been found to be necessary only to prepare one of the upper and the lower surfaces 38 or 40 to form a bondable surface so the pot covers 10 and 10*a* are formed from the sheets of material 12, 12*a*, or 12*b* have sufficient mechanical strength to retain their formed shape in accordance with the present invention. However, it should be noted that preparing both the upper and the lower surfaces 38 and 40 to form bondable surfaces provides additional mechanical strength which may be desired in some applications and particularly in those applications where the additional mechanical strength is needed to enable the formed article to maintain or retain its formed shape. Such additional strength may be desired either because of the particular shape of the article or the particular thickness or characteristics of the particular film forming the sheets of material 12, 12, or 12*b*. Various techniques are utilized to prepare the sheet of material with at least one bondable surface in accordance with the present invention.

One technique for preparing the bondable surfaces is to utilize polyvinyl chloride film to form the sheet of material which is heat sealable. When utilizing a processed organic polymer heat sealable film, the upper and the lower surfaces 38 and 40 of the sheet of material are bondable surfaces and the sheet of material must be heated during the forming of the article or, more particularly, the forming of overlapping folds 26. Thus, in this instance, the term "bondable contact" or "bondable engagement" means contacting engagement and the application of the required amount of heat to effect heat sealable bonding of the contacting surfaces.

It should be noted that a light activated adhesive also is suitable for use in preparing the bondable surface in accordance with the present invention. In this instance, heating elements would not be necessary; however, means for lighting the areas to be bonded would be necessary which might be effected by utilizing a light source during the forming of the pot covers 10 and 10*a*. In this instance, the term "bondable contact" or "bondable engagement" means contacting engagement and the applications of sufficient light to effect the bond.

Another technique for preparing the bondable surfaces is to utilize a non-heat sealable film to form the sheet of material and to apply a heat sealable coating to either the upper surface 38 or the lower surface 40 or both. Heat sealable adhesives are commercially available. The term "bondable contact" or "bondable engagement" as used in this instance means contacting engagement and the application of the required amount of heat to effect heat sealable bonding of the contacting surfaces. The heat sealable coating also can be a heat sealable lacquer, a pressure sensitive adhesive which also requires heat to effect the bond, or a non-melt adhesive.

An additional technique for preparing the bondable upper and lower surfaces 38 or 40 is to utilize a non-heat sealable film to form the sheet of material and to apply a contact adhesive or cohesive coating to either the upper surface 38 or the lower surface 40 or both. Contact adhesives, as well as cohesives are commercially available. The term "bondable contact" or "bondable engagement" in this instance means contacting engagement sufficient to effect the adhesive or cohesive bond between the contacted surfaces.

Figure 7:
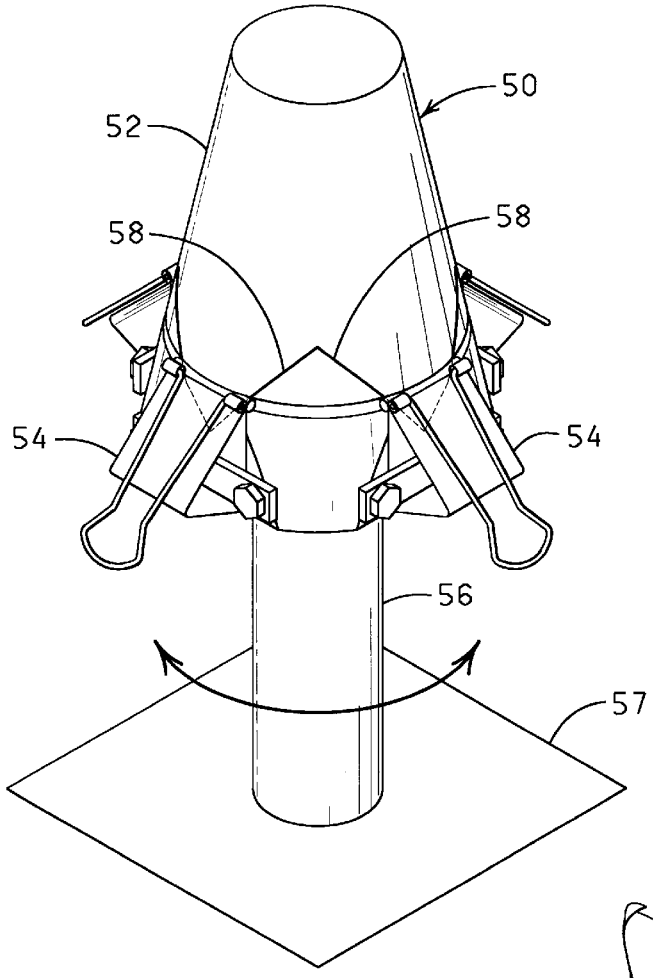
FIG. 7 is a perspective view of a forming jig used to form the flower pot covers of the present invention.

The pot covers 10 and 10*a* are formed initially using a folding jig 50, illustrated in FIG. 7. The folding jig 50 is sized according to the size of pot cover 10 or 10*a* desired to be formed and includes a form 52, a plurality of clips 54 fixed to a lower portion of the form 52 in a spaced relationship about the circumference of the form 52, and a pedestal 56 which is pivotally supported by a base 57. The form 52 further has a series of alignment marks 58.

In use, a sheet of material, such as the sheet of material 12, is placed on top of the forming jig 50 so as to center the sheet of material 12 on the top of the forming jig 50 and to align the four corners of the sheet of material 12 with the four clips 54. Next, one of the corners of the sheet of material 12 is folded downward so as to align the corner of the sheet of material 12 with the corresponding alignment mark 58. With the corner of the sheet of material 12 aligned with the alignment mark 58, the corner of the sheet of material 12 is positioned in the corresponding clip 54 to secure the corner of the sheet of material 12 to the forming jig 50.

Next, the oppositely disposed corner of the sheet of material 12 is folded downward and a slight tension is applied on the sheet of material 12 to remove any wrinkles in the sheet of material 12. The corner of the sheet of material 12 is aligned with the corresponding alignment mark 58. After aligning the corner of the sheet of material 12 with the alignment mark 58, the corner of the sheet of material 12 is positioned in the corresponding clip 54 to secure the corner of the sheet of material 12 to the forming jig 50.

The third and fourth corners of the sheet of material 12 are next folded down, aligned with their corresponding alignment marks 58, and positioned in their corresponding clips 54 as described above for the first and second corners of the sheet of material 12.

The portions of the sheet of material 12 extending directly above the clips 54 form four semi-flat sections with four flaps being formed between these semi-flat sections. The next step in the forming process is to rotate one of the flaps in a counterclockwise direction and pull it snug so as to remove all wrinkles in the flap. Once the flap is fully rotated against the forming jig 50, a crease is pressed into the most outward fold of the flap. The flap is then rotated 180° in a clockwise direction where a bonding material, such as an adhesive or double-sided tape, is applied to the flap. With the bonding material applied, the flap is rotated back 180° in a counterclockwise direction where the corresponding portions of the decoration 42 are registered with one another and the flap is bondingly connected to the adjacent portion of the sheet of material 12. This step is then repeated for the remaining three flaps whereupon the pot cover 10 is ready to be removed from the forming jig 50.

With the pot cover 10 removed from the forming jig 50, the flaps may be secured further by placing the pot cover 10 on a flat support surface and rotating it so that so that the inside fold of one of the flaps is lying flat on the support surface. The inside fold is then pressed and secured with a bonding material in a manner similar to that described above for the outside fold of the flap. This step is repeated for each of the remaining three flaps.

Upon forming the pot covers 10 and 10*a* as described above, the overlapping folds 26 may be further secured by taking the pot cover 10 or 10*a* and placing it between a heated male and a female mold (not shown). The male mold is brought into mating engagement with the female mold thereby heat sealing the overlapping folds 26.

FIG. 8 illustrates another version of a pot cover 70 constructed in accordance with the present invention. The pot cover 70 is illustrated as being formed from the sheet of material 12*a* illustrated in FIG. 4 and is substantially similar to the pot cover 10 described above with the exception that the overlapping folds 26 of the pot cover 70 are not bonded or otherwise connected. Thus, the primary purpose of the overlapping folds 26 is not to provide structural integrity to the pot cover 70. Instead, the overlapping folds 26 substantially control the shape of pot cover 70 upon the sidewall 16 being formed about a flower pot or other plant container by an individual or a forming device. Further, the unconnected folds 26 facilitate shipping and storage of the pot cover in that the pot cover 70 is positionable in a substantially relaxed or flatted condition, as shown in FIG. 4.

In use, a pot such as the one designated in FIG. 8 by reference numeral 36 is disposed on the planar bottom 14 of the pot cover 70. The sidewall 16 of the pot cover 70 is then formed about the pot 36 such that the pot 36 is substantially covered by the sidewall 16. Typically, the pot 36 contains a plant or floral grouping 37 which extends a distance above the upper end of the pot 36. After the pot 36 has been covered by the sidewall 16, the sidewall 16 is secured to the pot 36 with a securing member 72. The securing member 72 is shown in FIG. 8 to be an elastic band. However, it will be appreciated that the securing member may also include ties, labels, ribbons, strings, tapes (including single or double-sided adhesive tapes), staples or combinations thereof.

Figure 9:
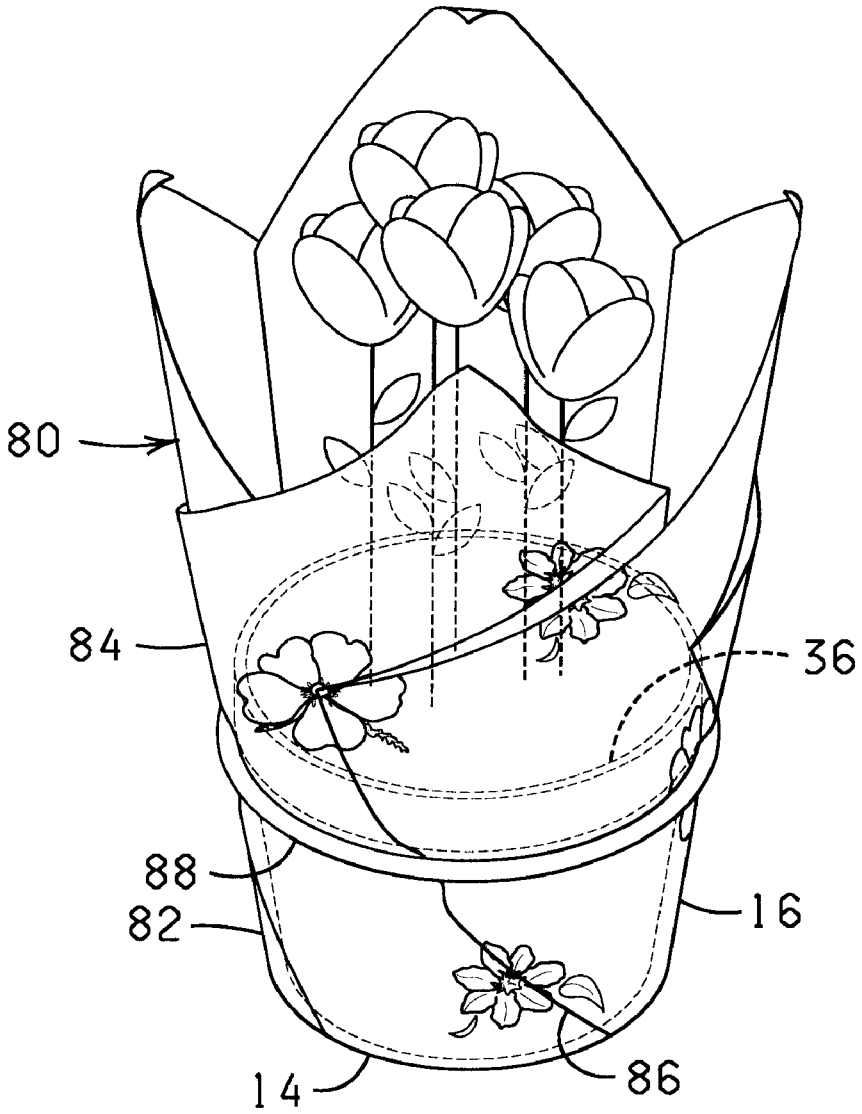
FIG. 9 is a perspective view of another embodiment of a pot cover constructed in accordance with the present invention.

FIG. 9 illustrates another embodiment of a pot cover 80. The pot cover 80 is substantially similar to the pot cover 10 with the exception that the pot cover 80 includes a lower portion 82 and an upper portion 84. The lower portion 82 comprises a portion of the sidewall 16 which has a plurality of overlapping folds, such as fold 86, which are connected by a bonding material. The upper portion 84 comprises a portion of the sidewall 16 wherein the folds 86 are unbonded or unconnected, thus the upper portion 84 of the sidewall 16 is left substantially unbonded, resulting in the upper portion 84 of the sidewall 16 having a more billowy or fluted appearance in comparison to the flatter appearance of the bonded lower portion 82.

In use, a pot such as the one designated in FIG. 9 by reference numeral 36 is disposed on the planar bottom 14 of the pot cover 80 and into the lower portion 82 of the sidewall 16. The upper portion 84 of the sidewall 16 of the pot cover 80 is then formed about the pot 36 such that the pot 36 is substantially covered by the sidewall 16. After the pot 36 has been covered by the sidewall 16, the upper portion 84 of the sidewall 16 is secured to the pot 36 with a securing member 88. The securing member 88 is shown in FIG. 9 to be an elastic band. However, it will be appreciated that the securing member 88 may also include ties, labels, ribbons, strings, tapes (including single or double-sided adhesive tapes), staples or combinations thereof.

The sheets of material 12, 12*a*, 12*b* used in accordance with the present invention may be constructed from a material selected from the group of materials consisting of paper (treated or untreated), foil, polymer film, fabric (natural or synthetic, woven or nonwoven), or burlap or combinations or laminations thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

The sheets of material 12, 12*a*, and 12*b* or other embodiments described herein may vary in color, and may be opaque, translucent or partially clear or tinted transparent. The sheets of material described herein may be constructed of a single layer of material or a plurality of layers of the same different types of materials. Any thickness of the sheet of material may be utilized in accordance with the present invention as long as the sheet of material is formable into a pot cover with a skirt, as described herein. The layers of material comprising the sheet of material may be connected together or laminated or may be separate layers, and the layers of material comprising the sheet of material need not be uniform in shape or composition.

As noted above, the sheet of material may be constructed of a single layer of material or a plurality of layers of the same or different types of materials. Any thickness of the sheet of material may be utilized in accordance with the present invention as long as the sheet of material may be formed into a flower pot cover, as described herein. Additionally, an insulating material such as bubble film, preferable as one of two or more layers, can be utilized in order to provide additional protection for the item wrapped therein.

The decorations 42, 44, and 46 may consist of designs or decorative patterns which are printed, etched, and/or embossed thereon using inks or other printing materials. An example of an ink which may be applied to the surface of the sheets of material described herein is described in U.S. Pat. No. 5,147,706, entitled "Water Based Ink On Foil And/Or Synthetic Organic Polymer" issued to Kingman on Sep. 15, 1992, and which is hereby incorporated herein by reference. In addition, the decorations 42, 44, and 46 described herein may have various colorings, coatings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper and/or lower surface of the sheets of material described herein. Moreover, each decoration described herein may vary in the combination of such characteristics.

The term "bonding material" when used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes material which are heat sealable and, in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer which may be applied to the sheet of material and, in this instance, heat, sound waves, or vibrations, also must be applied to effect the sealing.

The sheet of material used herein may further comprise at least one scent (not indicated in the figures). Examples of scents utilized herein include, but are not limited to, floral scents (flower blossoms, or any portion of a plant), food scents (chocolate, sugar, fruits), or herb or spice scents (cinnamon), and the like. Additional examples of scents include flowers (such as roses, daisies, lilacs), plants (such as fruits, vegetables, grasses, trees), foods (for example, candies, cookies, cake), food condiments (such as honey, sugar, salt), herbs, spices, woods, roots, and the like, or any combination of the foregoing. Such scents are known in the art, and are commercially available.

The scent may be disposed upon the sheet of material 12 by spraying the scent thereupon, painting the scent thereupon, brushing the scent thereupon, lacquering the scent thereupon, immersing the sheet of material in a scent-containing liquid, exposing the sheet of material to scent-containing gas, or any combination thereof.

The scent may be contained within a lacquer, or other liquid, before it is disposed upon the sheet of material. The scent may also be contained within a dye, ink, and/or pigment (not shown). Such dyes, inks and pigments are known in the art, and are commercially available, and may be disposed upon or incorporated in the sheet of material 12 by any method described herein or known in the art.

The term "floral grouping" where used herein, means cut fresh flowers, artificial flowers, a single flower, other fresh and/or artificial plants or other floral materials and may include other secondary plants and/or ornamentation or artificial or natural materials which add to the aesthetics of the overall floral arrangement. The floral grouping comprises a bloom or foliage portion and a stem portion. However, it will be appreciated that the floral grouping may consist of only a single bloom or only foliage (not shown). The term "floral grouping" may be used interchangeably herein with the term "floral arrangement".

From the above description, it is clear that the present invention is well adapted to carry out the objects and to attain the advantages mentioned herein as well as those inherent in the invention. While a presently preferred embodiments of the invention have been described for purposes of this disclosure, it will be readily understood that numerous changes may be made which will readily suggest themselves to those skilled in the art and which are accomplished within the spirit of the invention disclosed.

What is claimed is:

1. A flower pot cover, comprising:

a flexible sheet of material having an upper surface and a lower surface, the lower surface provided with a decoration, the sheet of material shaped to form a substantially closed planar bottom end, a sidewall extending from the bottom end, an open upper end, and an object opening dimensioned to receive a flower pot, the sidewall having a plurality of overlapping folds and a plurality of corresponding panel sections, the panel sections formed in an alternating relationship with respect to the overlapping folds and being substantially free of folds, the decoration being provided on the bottom surface of the sheet of material so that one portion of the decoration is positioned on one of the panel sections and is registered with another portion of the decoration which is positioned on one of the adjacent panel sections upon the overlapping folds being formed in the base portion whereby the decoration extends continuously from one panel section to the adjacent panel section without being substantially mutilated by the overlapping folds of the sidewall, wherein the overlapping portions of the overlapping folds of the sidewall are unbonded, and wherein the flower pot cover further comprises a securing member positionable about the sidewall for securing the sidewall to the flower pot.

2. The cover of claim 1 wherein the decoration is printed on the sheet of material.

3. The cover of claim 1 wherein the decoration is embossed in the sheet of material.

4. The cover of claim 1 wherein the decoration is etched in the sheet of material.

5. A flower pot cover, comprising:

a flexible sheet of material having an upper surface and a lower surface, the lower surface provided with a decoration, the sheet of material shaped to form a substantially closed planar bottom end, a sidewall extending from the bottom end, an open upper end, and an object opening dimensioned to receive a flower pot, the sidewall having a plurality of overlapping folds and a plurality of corresponding panel sections, the panel sections formed in an alternating relationship with respect to the overlapping folds and substantially free of folds, the decoration being provided on the bottom surface of the sheet of material so that the decoration is positioned on the panel sections upon the overlapping folds being formed in the base portion without the decoration being substantially mutilated by the overlapping folds of the sidewall, wherein the overlapping portions of the overlapping folds of the sidewall are unbonded, and wherein the flower pot cover further comprises a securing member positionable about the sidewall for securing the sidewall to the flower pot.

6. The cover of claim 5 wherein the decoration is printed on the sheet of material.

7. The cover of claim 5 wherein the decoration is embossed in the sheet of material.

8. The cover of claim 5 wherein the decoration is etched in the sheet of material.

9. A flower pot cover, comprising, a flexible sheet of material having an upper surface and a lower surface, the lower surface provided with a decoration, the sheet of material shaped to form a substantially closed planar bottom end, a sidewall extending from the bottom end, an open upper end, and an object opening dimensioned to receive a flower pot, the sidewall including a base portion and a skirt portion extending from the top of the base portion and being substantially free of folds, the base portion having a plurality of overlapping folds and a plurality of corresponding panel sections, the panel sections formed in an alternating relationship with respect to the overlapping folds and being substantially free of folds, the decoration being provided on the bottom surface of the sheet of material so that one portion of the decoration is positioned on one of the panel sections and is registered with another portion of the decoration which is positioned on one of the adjacent panel sections upon the overlapping folds being formed in the base portion whereby the decoration extends continuously from one panel section to the adjacent panel section without being substantially mutilated by the overlapping folds of the sidewall, wherein the overlapping portions of the overlapping folds of the sidewall are unbonded, and wherein the flower pot cover further comprises a securing member positionable about the sidewall for securing the sidewall to the flower pot.

10. The cover of claim 9 wherein the decoration is printed on the sheet of material.

11. The cover of claim 9 wherein the decoration is embossed in the sheet of material.

12. The cover of claim 9 wherein the decoration is etched in the sheet of material.

13. A flower pot cover, comprising:

a flexible sheet of material having an upper surface and a lower surface, the lower surface provided with a decoration, the sheet of material shaped to form a substantially closed planar bottom end, a sidewall extending from the bottom end, an open upper end, and an object opening dimensioned to receive a flower pot, the sidewall including a base portion and skirt portion extending from the top of the base portion and being substantially free of folds, the base portion having a plurality of overlapping folds and a plurality of corresponding panel sections, the panel sections formed in an alternating relationship with respect to the overlapping folds and substantially free of folds, the decoration being provided on the bottom surface of the sheet of material so that the decoration is positioned on the panel sections upon the overlapping folds being formed in the base portion without the decoration being substantially mutilated by the overlapping folds of the sidewall, wherein the overlapping portions of the overlapping folds of the sidewall are unbonded, and wherein the flower pot cover further comprises a securing member positionable about the sidewall for securing the sidewall to the flower pot.

14. The cover of claim 13 wherein the decoration is printed on the sheet of material.

15. The cover of claim 13 wherein the decoration is embossed in the sheet of material.

16. The cover of claim 13 wherein the decoration is etched in the sheet of material.

17. A method of forming a flower pot, comprising:

providing a flexible sheet of material having an upper surface and a lower surface, the lower surface provided with a decoration, shaping the sheet of material to form a substantially closed planar bottom, a sidewall extending from the planar bottom and having a plurality of overlapping folds and a plurality of corresponding panel sections, an open upper end, and an object opening dimensioned to receive a flower pot, the panel sections formed in an alternating relationship with respect to the overlapping folds and being substantially free of folds, the sheet of material being further shaped so that one portion of the decoration is positioned on one of the panel sections and is registered with another portion of the decoration which is positioned on one of the adjacent panel sections upon the overlapping folds being formed in the base portion whereby the decoration extends continuously form one panel section to the adjacent panel section without being substantially mutilated by the overlapping folds of the sidewall, wherein the overlapping portions of the overlapping folds of the sidewall are unbonded, and wherein the method further comprises securing the sidewall to the flower pot disposed in the object opening.

18. A method of forming a flower pot cover, comprising:

providing a flexible sheet of material having an upper surface and a lower surface, the lower surface provided with a decoration, shaping the sheet of material to form a substantially closed planar bottom, a sidewall extending from the planar bottom and having a plurality of overlapping folds and a plurality of corresponding panel sections, an open upper end, and an object opening dimensioned to receive a flower pot, the panel sections formed in an alternating relationship with respect to the overlapping folds and being substantially free of folds, the sheet of material being further shaped so that the decoration is positioned on the panel sections upon the overlapping folds being formed in the base portion without the decoration being substantially mutilated by the overlapping folds of the sidewall, wherein the overlapping portions of the overlapping folds of the sidewall are unbonded, and wherein the method further comprises securing the sidewall to the flower pot disposed in the object opening.

* * * * *